US005179889A

United States Patent [19]

Wüsthof et al.

[11] Patent Number: 5,179,889

[45] Date of Patent: Jan. 19, 1993

[54] RADIAL PISTON ENGINE

[75] Inventors: Peter Wüsthof, Lohr, Fed. Rep. of Germany; Sinclair Cunningham, Fife, Scotland

[73] Assignee: Mannesmann Rexroth GmbH, Lohr, Fed. Rep. of Germany

[21] Appl. No.: 656,191

[22] Filed: Feb. 15, 1991

[30] Foreign Application Priority Data

Feb. 16, 1990 [DE] Fed. Rep. of Germany ..... 4004932

[51] Int. Cl.[5] ..... F01B 1/06

[52] U.S. Cl. ..... 91/491; 92/72; 417/462

[58] Field of Search ..... 417/462; 91/491, 492; 92/169.1, 72

[56] References Cited

U.S. PATENT DOCUMENTS 3,913,455 10/1975 Green ..... 91/492
4,704,948 11/1987 Wusthof ..... 91/491
4,719,843 1/1988 Noel ..... 91/491
4,747,339 5/1988 Wusthof ..... 92/72
4,898,076 2/1990 Bigo ..... 91/491
4,953,524 9/1990 Wusthof et al. .

FOREIGN PATENT DOCUMENTS 0046691 3/1982 European Pat. Off. .
3531632 3/1987 Fed. Rep. of Germany .
3828131 2/1990 Fed. Rep. of Germany .
2086991 5/1982 United Kingdom .
2180011 3/1987 United Kingdom .

*Primary Examiner*—Richard A. Bertsch
*Assistant Examiner*—Peter Korytnyk
*Attorney, Agent, or Firm*—Cushman, Darby & Cushman

[57] ABSTRACT

A radial piston engine is provided having recesses in the area of movement of the rollers, adapted to receive roller sections on both roller end faces. For guiding the roller end faces, oppositely located guide surfaces are milled in the cylinder block for said rollers.

10 Claims, 5 Drawing Sheets

RADIAL PISTON ENGINE

TECHNICAL FIELD

This invention relates to a radial piston engine and in particular to a radial piston motor of the type shown in German Patent 35 31 632.

BACKGROUND ART

German Patent 35 31 632 (and also U.S. Pat. No. 4 953 524 which refers to said German Patent) teaches a radial piston engine comprising a housing, an annular cam disk fixedly mounted in said housing, a cylinder block rotatably mounted about an axis and with respect to said cam disk, a plurality of bores arranged in said cylinder block radially with respect to said axis of rotation, a plurality of pistons respectively mounted in said bores, and cylindrical rollers for supporting said pistons on said cam disk, said rollers having axes which extend parallel to the axis of rotation of the cylinder block, and wherein said bores of said cylinder block which are adapted to receive said pistons are provided with recesses in the area of movement of said rollers, so as to receive sections of said rollers on both end faces of said rollers. Said recesses comprise circumferential grooves which need to have a certain depth so as to allow an insertion of said rollers into said bores provided in said pistons, while at the same time, a lateral guidance of the rollers is provided at rest or contacting surfaces of the lateral wall of the cylinder block. So as to achieve this goal, a relatively large depth is required for the circumferential grooves. This leads to a weakening of the segments remaining between each two adjacent piston bores, i.e. segments which are necessary to support the pistons. Said segments are subjected to bending forces due to the effect of the piston force during operation. Thus the danger of breakage exists. This is particularly so for continuous operation of the engine.

German Offenlegungsschrift 38 28 131.7 (to which the above U.S. patent corresponds), published after the priority date of the present application, discloses a radial piston engine which intends to further develop in particular the radial piston engine of German Offenlegungsschrift 35 31 632 such that the disadvantages of such known engines of this type are avoided. In particular, the dangers of a breakage or breakage during long term operation should be excluded.

DISCLOSURE OF THE INVENTION

It is an object of the present invention to provide a radial piston engine of the type shown in German Offenlegungsschrift 35 31 632 such that good guidance is assured for the rollers. At the same time low cost machining operations should be useable to provide for the necessary guide surfaces in the cylinder block.

It is another object of the invention to effectively use the entire roller as a supporting body and to further reduce the risk of breakage.

In accordance with the invention a radial piston engine comprises a housing; an annular cam disk fixedly mounted to said housing; a cylinder block rotatably mounted with respect to said cam disk about an axis; a plurality of bores in said cylinder block, arranged radially with respect to the rotational axis of the cylinder block; pistons movably mounted within said bores; cylindrical rollers for supporting said pistons on said cam disk, said rollers having axes extending parallel to the axis of rotation of said cylinder block; first recesses in the area of movement of said rollers adapted to receive roller sections on both end faces of said rollers; guide surfaces oppositely located in the cylinder block for guiding the end surfaces of said rollers; and piston rings provided on said pistons at a predetermined location; wherein the radially extending depth of said guide surfaces is above the location of said piston rings for said pistons being in their upper dead center.

Preferred embodiments of the invention can be gathered from the dependent claims.

In accordance with a preferred embodiment of the invention, the piston ring is located at the lower or bottom end of the piston. Due to this measure, a large supporting surface remains between the piston and the bore and thus serves for the transfer of the torque. The wear of the piston will be drastically reduced for such a design and such a position of the piston ring.

BRIEF DESCRIPTION OF THE DRAWINGS

FIG. 1 shows a radial piston engine of the prior art comprising a first half 1 of a housing and a second half 2 of the housing. Between said two halves of the housing, a cam disk 3 is arranged. By means of mounting bolts 4, the two housing halves form together with the cam disk a fixed unit. Within the housing half 1, a shaft 5 is mounted by means of ball bearings 6,7. The end 8 of the shaft facing the housing is designed as a multi-key shaft and supports via a corresponding recess 9 a rotor 10. The rotor 10 a cylinder block and comprises uniformly spaced about its circumference bores 11 adapted to receive pistons 12. The pistons 12 are provided in their radially outer area with a recess for receiving a bearing dish or cup 13 and the cylindrical roller 14. The rollers 14 are supported by the curved or cam path 17 of the cam disk 3. In the radially lower area of the piston 12, a circumferentially extending groove is provided within which a piston ring serving as a sealing element is located. Said bores 11 form piston chambers which are operationally connected via axially extending bores 21 with control bores 22,23. Said control bores 22,23 also extend axially, and they are located in a stationary control sleeve 24 in the housing half 2. The control sleeve 24 determines or limits circumferential control chambers 25,26 which are connected via ports (not shown) to the source of pressure medium and the tank, respectively. Depending on the position of the bores or piston chambers 11 with respect to the control bores 22,23, they are either connected with the pressure source or with the tank, and thus a torque is exerted onto the rotor 10. Said torque is transmitted via said multi-key connection to the input shaft and the output shaft 5, respectively.

Figure 1:
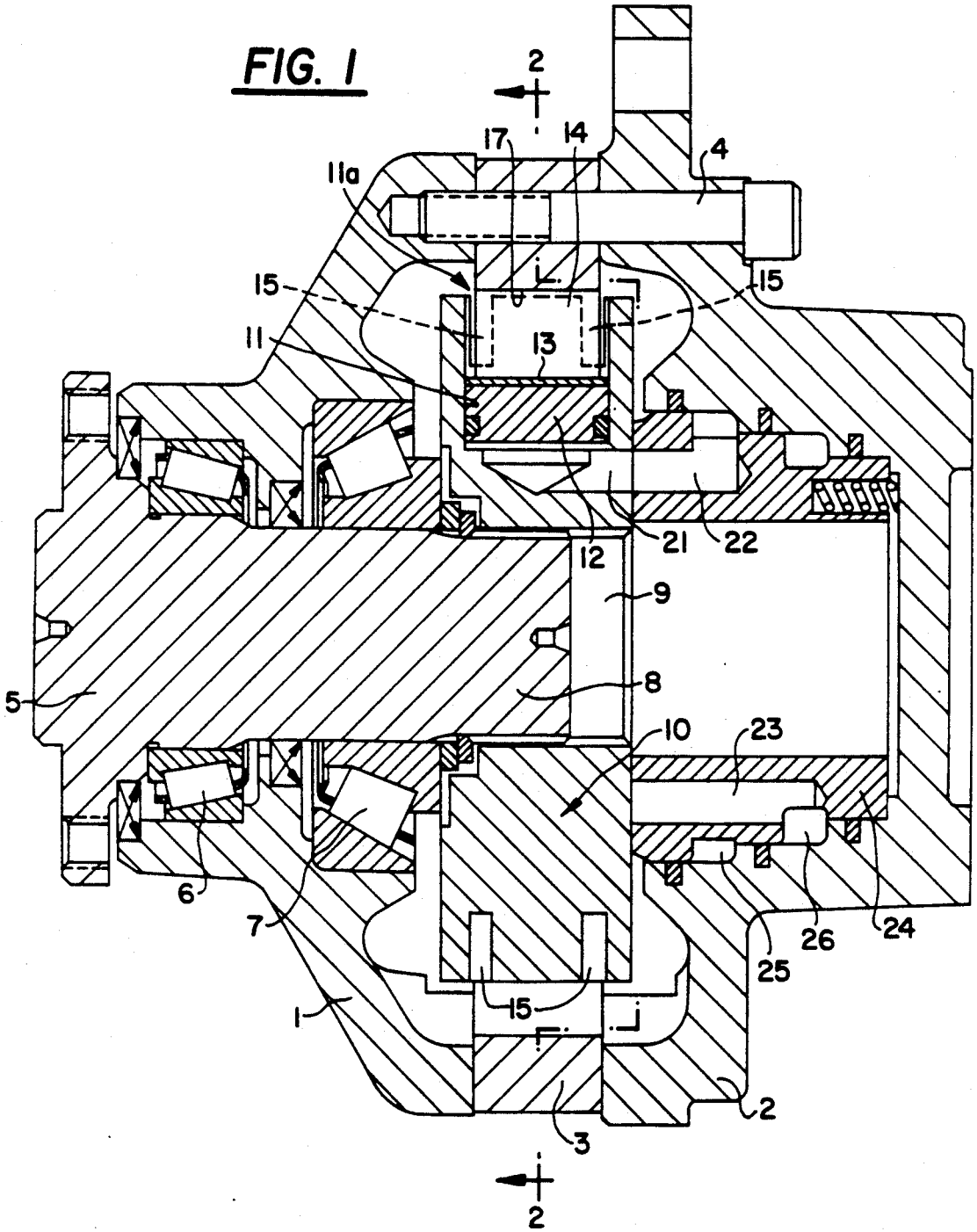
FIG. 1 is an axial longitudinal cross-sectional view of a radial piston engine of the prior art, i.e. in accordance with German Offenlegungsschrift 35 31 632, showing a machine to which the present invention primarily refers.
Figure 3:
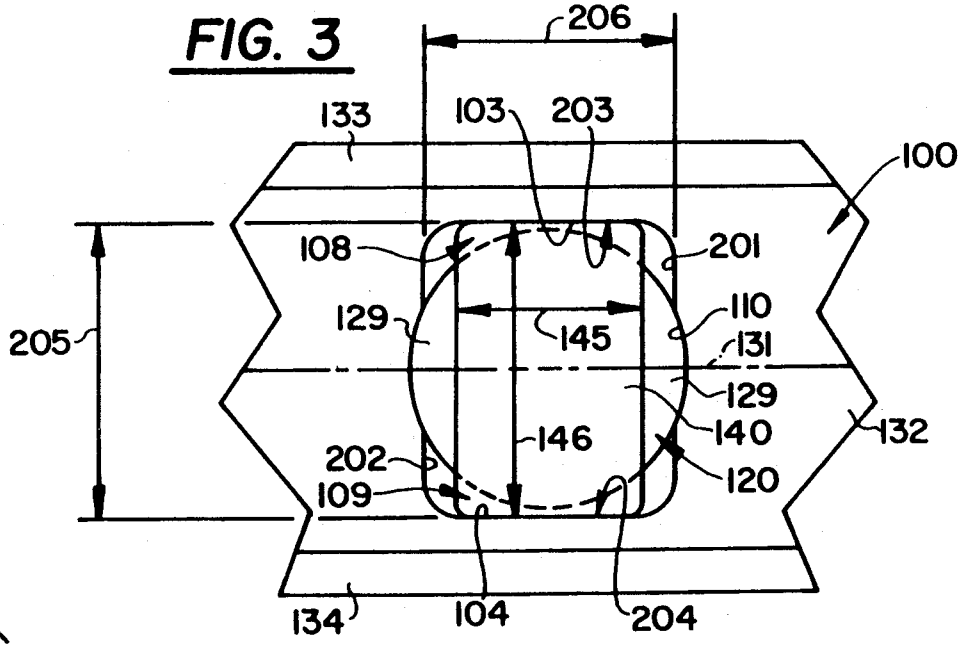
FIG. 3 is a partial plan view of the rotor as seen from the arrow D in FIG. 2.
Figure 4:
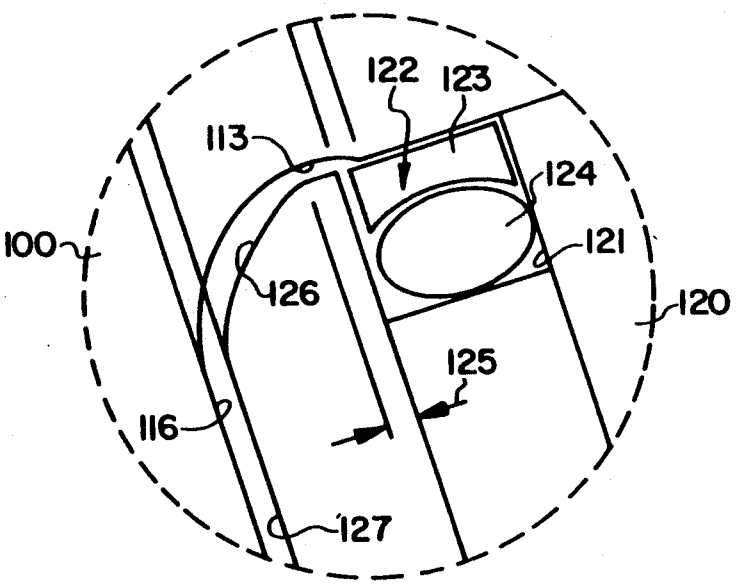
FIG. 4 is a detail A in FIG. 2.
Figure 5:
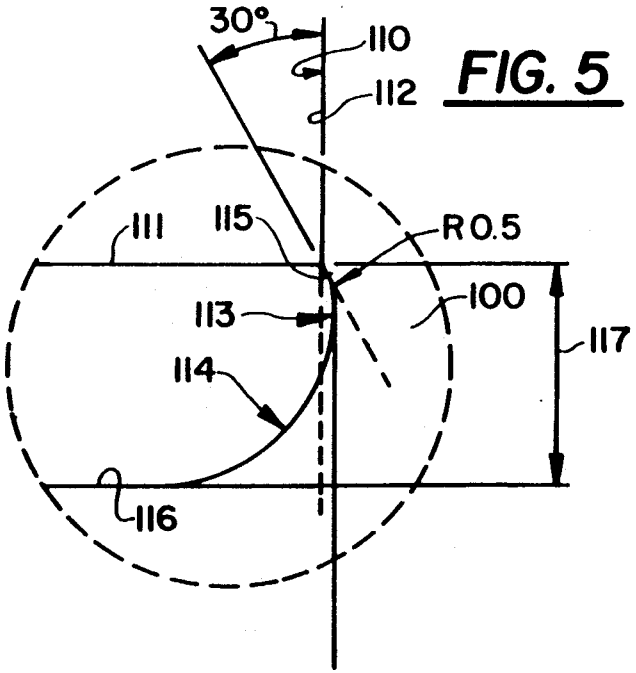
FIG. 5 is a detail B in FIG. 2.

The prior art radial piston engine of FIG. 1 comprises, as is shown in detail in FIG. 3 to 5 of said German Offenlegungsschrift 35 31 632, four recesses 11*a* for each piston adapted to receive sections of the roller 14. Said recesses 11*a* are —in the case of the prior art radial piston engine— the result of the circumferential groove 15 in the rotor 10, and they are thus a part of the grooves. The grooves 15 are designed such that their outer bordering walls provide at the same time the axial guidance of the side or end faces of the rollers. The inwardly extending depth of the circumferential grooves 15 can be reduced insasmuch as the roller 14 can be inserted partially into the existing piston bore 11.

Referring now to FIGS. 2 to 7, an embodiment of a radial piston engine of the invention is described. Initially it is noted that the radial piston engine of the invention differs from the radial piston engine of FIG. 1 only by the different design of its rotor 100. The differences with regard to the rotor 100 are in the different design of the spaces which are provided for receiving the piston 12 and the rollers 14. In particular, in accordance with the present invention, the circumferential grooves of FIG. 1 are no longer required.

Figure 2:
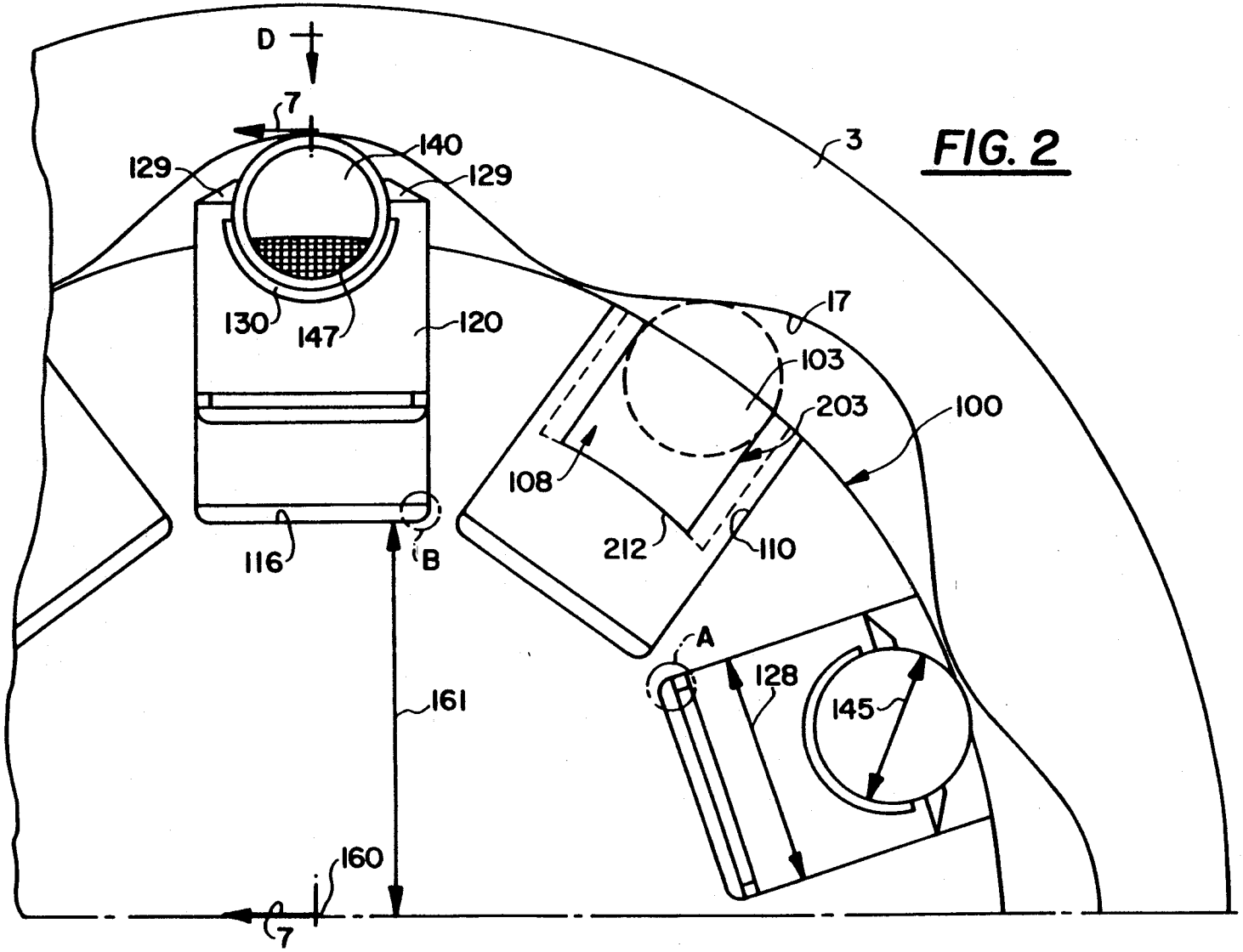
FIG. 2 is a schematic partial sectional view along line 2—2 in FIG. 1, however, in accordance with an embodiment of the invention.

The radial piston engine of the invention shown in FIGS. 2 through 7 comprises like the prior art of FIG. 1 a cam disk 3 having a cam path 17. The rotor or the cylinder block is referred to by reference numeral 100. The cylinder block 100 is adapted to rotate about a longitudinal rotary axis 160. A plurality of piston bores 110 is provided about the circumference of the rotor 100. Said bores 110 extend radially inwardly. In each bore 110, a piston 120 is reciprocally mounted. Each piston 120 is supported by means of an idler roller 140 at the cam path 17 in a known manner. As can be see from FIGS. 2 and 3, roller 140 is not a ball but is a wheel-type roller which is circular in side elevation (FIG. 2) and rectangular in top plan (FIG. 3—taken in direction D from FIG. 2). Roller 140 has a maximum diameter 145 through its entire thickness 146 and thus could not follow piston 120 in cylindrical bore 100 unless cutouts or recesses 108 and 109 are provided as described below.

Each piston bore 110—see specifically FIG. 5 ends in the area of the base 117 of the bore (bore base 117) in a bottom 116 of the bore (bore bottom 116). It can be seen in FIG. 5 that the piston bore 110 extending from the circumference 132 of the cylinder block initially has a cylindrical bore wall 112 which ends in FIG. 5 at line 111. After the piston bore is formed in the cylinder block 100, a second recess 113 is provided in the bore base 117. Said second recess 113 extends initially outwardly forming an angular section 115 extending under an angle of 30°. Thereupon, said recess merges with the bore bottom 116 along a circular path defined by the radius 114. More particularly, in as much a bore 110 is not a through bore but a blind bore, providing the proper finish of the surface shown in dotted lines in the detail of FIG. 5 would be very difficult because the finishing tool would not have sufficient space for operation due to the closeness of bottom 116 of the blind bore 110. By providing recess 113 as shown, the need for a finishing operation in the area of recess 113 is unnecessary. As a consequence, bore 110 can be readily machined, i.e., there are no complications in machining because the bore 110 needs only be finished in the area upward from where recess 113 begins. In the area of recess 113 no finishing at all is necessary because there is no engagement with the piston. As is shown in FIG. 4, the seal 123, 124 can be brought close to recess 113 without causing any problems. Thus, the existence of the second recess 113 has the following advantages: The bore 110 can be readily machined; the seal 123,124 (see FIG. 4) can be brought close to the recess; and the pistons can move inwardly up to the bore bottom 116, thus making effective use of the available space.

As shown in FIG. 4, the piston 120 is sealed in said bore 110 by means of a piston seal 122. The piston seal 122 comprises a piston ring 123 and a resilient element 124 arranged behind said piston ring 123. The piston seal 122 is located in an annular recess 121 of the piston. The piston ring 123 is arranged as closely as possible to the lower end of the piston 120. This way, a large remaining supporting support surface is created between the piston 120 and the piston bore 110 for transmitting the torque. The wear of the piston 120 will be drastically reduced for such a design and such positioning of the piston ring 123.

FIG. 4 discloses a detail A of FIG. 2 and it can be recognized that the piston 120 has diameter which tapers continuously along line 126 and eventually ends at the head (bottom) 127 of the piston. It is further recognized that, in the direction towards the piston head and following the recess 121, initially there is a circular cylindrical section 125 which is then followed by the tapering piston section already mentioned.

In particular FIG. 3 discloses that the piston bores 110 are formed along a circumferentially extending center line 131 of the circumference of the cylinder block 132. The circumference 132 of the cylinder block comprises on both sides inclined surfaces or phases 133 and 134. In FIG. 2 the diameter of the piston is referred to by reference numeral 128.

In the radially outer end of the piston 120, the roller 140 is mounted by means of a bearing cup 130, and two arms 129 of the piston 120 support said roller 140.

Figure 7:
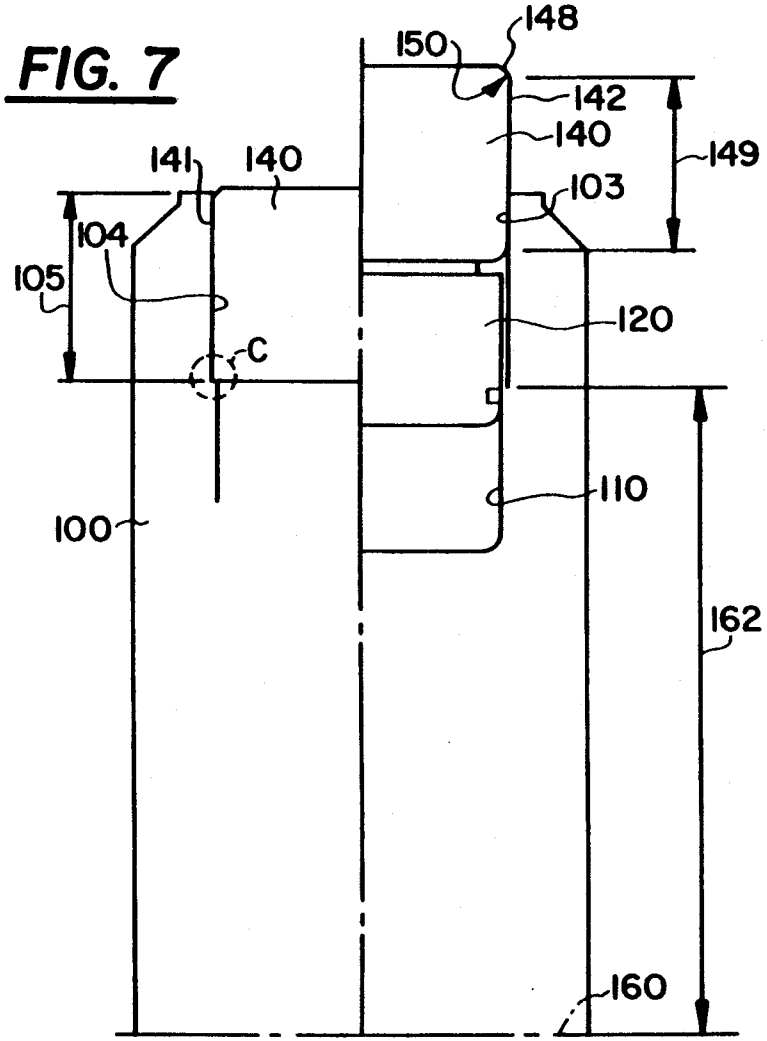
FIG. 7 is a partial sectional view along line 7—7 in FIG. 2 showing in the right half of said sectional view the piston in its extended position.

As is shown specifically in FIG. 7, the roller 140 has a circular cylindrical cross section and comprises two roller end faces 141,142. The roller sections forming the roller end faces 141,142 extend beyond the, diameter 128 of the bore 110. To make this possible, two first recesses 108 and 109 (FIG. 3) are machined in the axial direction of the cylinder block 100. Preferably said recesses are milled. The width of the recess in the direction of the circumference is referred to by reference numeral 206. The wall 203 of the recess forms a guide surface 103 for the roller 140. Opposite to the recess wall 203 is a recess wall 204 which forms a guide surface 104 for the roller 140. Preferably—as is shown in FIG. 2—the width of the first recesses 108,109 is only a little bit wider than the width of the guide surface 103,104 which corresponds approximately to the diameter 145 of the roller 140. By a milling operation, the larger recess width 206 is created as shown by a dashed line in FIG. 2.

The lateral guide surfaces 103,104 are preferably milled up to a depth (see FIG. 2) which ends above the piston ring when the piston is in its upper dead center. The dead center is shown in FIG. 2 for the piston which is located below arrow D. Also, the minimal contact area of the roller 140 with the appropriate guide surface 103,104 is referred to by reference numeral 147 and is crosshatched. It can be recognized, in particular in FIG. 3, that the length 146 of the roller corresponds in substance to the diameter 205 of the piston bore 110.

As already mentioned, the diameter 145 of the roller is in the range of the width of the guide surfaces 103,104, and the width of the recess 206 is somewhat smaller than the diameter of the piston bore 205.

Figure 6:
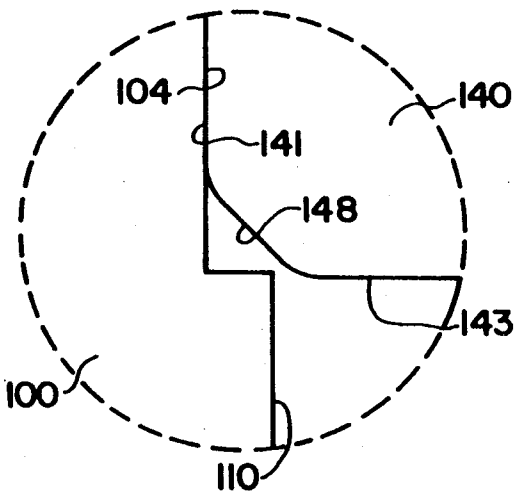
FIG. 6 is a detail C in FIG. 7.

In particular FIG. 6 discloses that the roller 140 comprises an inclination 148 between the side surfaces 141,142 and the running surface 143.

We claim:

1. A radial piston engine comprising:

a housing;

an annular cam disk (3) fixedly mounted in said housing;

a cylinder block (100) rotatably mounted about an axis with respect to said cam disk (3);

a plurality of bores (110) extending in said cylinder block radially with respect to said rotational axis;

a plurality of pistons (120) respectively reciprocally mounted within said bores 9110);

cylindrical rollers (14) for supporting said pistons (120) on said cam disk (3), said rollers having two oppositely located end surfaces and axes which extend parallel to the rotational axis of said cylinder block, and first recesses (108,109) machined in said cylinder block, in the absence of forming circumferential grooves in the area of movement of said rollers so as to define a generally rectangular bore adapted to receive roller sections at both end surfaces of the rollers, guide surfaces (103,104) for each roller oppositely and laterally arranged in said cylinder block for guiding said roller end surfaces, wherein the radially extending depth of the guide surfaces (103,104) ends above the piston ring (123) when the piston (120) has reached its upper dead center.

2. The radial piston engine of claim 1, wherein the piston bore (110) in the cylinder block (100) comprises a second recess (113) in the base of the bore.

3. The radial piston engine of claim 2, wherein the diameter (145) of the roller is smaller than the diameter of the piston so that arms (129) supporting said roller are created.

4. The radial piston engine of claim 2, wherein the second recess (113) starts from a cylindrical bore wall (112) and extends initially outwardly with respect to a vertical line, preferably under an angle of 30°, and thereupon merges along the arc of a circle with the bottom (116) of the bore (see FIG. 5).

5. The radial piston engine of claim 1, wherein the piston ring (123) is located at the lower end of the piston (120) so as to provide a large remaining backing support surface between the piston and the bore for the transfer of torque.

6. The radial piston engine of claim 1, wherein the diameter (205) of the piston bore (110) corresponds in substance to the length (146) of the roller.

7. A radial piston engine of claim 1, wherein said lateral guide surfaces are milled.

8. A radial piston engine comprising:

a housing;

an annular cam disk (3) fixedly mounted in said housing;

a cylinder block (100) rotatably mounted about an axis with respect to said cam disk (3);

a plurality of bores (110) extending in said cylinder block radially with respect to said rotational axis;

a plurality of pistons (120) respectively reciprocally mounted within said bores (110), each piston bore (110) in the cylinder block (100) comprising a recess (113) in the base of the bore, the recess (113) starting from a cylindrical bore wall (112) and extending initially outwardly with respect to a vertical line, under an angle of about 30°, and thereupon merges along the arc of a circle with the bottom (116) of the bore;

cylindrical rollers (14) for supporting said pistons (120) on said cam disk (3), said rollers having two oppositely located end surfaces and axes which extend parallel to the rotational axis of said cylinder block, and first recesses machined (108,109) in said cylinder block, in the absence of forming circumferential grooves, in the area of movement of said rollers so as to define a generally rectangular bore adapted to receive roller sections at both end surfaces of the rollers, guide surfaces (103,104) for each roller oppositely and laterally arranged in said cylinder block for guiding said roller end surfaces, wherein the radially extending depth of the guide surfaces (103,104) ends above the piston ring (123) when the piston (120) has reached its upper dead center.

9. A method of manufacturing piston and roller receiving chambers in a cylinder block of a radial piston engine, comprising a housing, an annular cam disk (3) fixedly mounted in said housing, a cylinder block (100) rotatably mounted about an axis with respect to said cam disk (3), a plurality of bores (110) extending in said cylinder block radially with respect to said rotational axis, a plurality of pistons (120) respectively reciprocally mounted within said bores (110), cylindrical rollers (14) for supporting said pistons (120) on said cam disk (3), said rollers having two oppositely located end surfaces and axes which extend parallel to the rotational axis of said cylinder block, first recesses (108,109) machined in said cylinder block in the absence of forming circumferential grooves, in the area of movement of said rollers so as to define a generally rectangular bore adapted to receive roller sections at both end surfaces of the rollers, guide surfaces (103,104) for each roller oppositely and laterally arranged in said cylinder block for guiding said roller end surfaces, wherein the radially extending depth of the guide surfaces (103,104) ends above the piston ring (123) when the piston (120) has reached its upper dead center and, characterized in that initially the piston bore (110) is formed in the cylinder block, and that thereupon for the two roller end faces for each piston bore lateral guide surfaces are formed up to a depth which ends above a piston ring of the piston when the piston is in the upper dead point center.

10. The method of claim 9, wherein a second recess is formed in the base of the bore at the piston head prior to milling said lateral guide surfaces.

* * * * *